United States Patent [19]

Rodgers et al.

[11] 4,388,782

[45] Jun. 21, 1983

[54] HANDHOLE SEAT RESURFACING TOOL FOR NAVAL PRESSURE FIRED BOILERS

[75] Inventors: David T. Rodgers, Turnersville, N.J.; Thomas P. Tursi, Horsham; Thomas J. Bryan, Woodlyn, both of Pa.

[73] Assignee: The United States of America as represented by the Secretary of the Navy, Washington, D.C.

[21] Appl. No.: 258,068

[22] Filed: Apr. 24, 1981

[51] Int. Cl.[3] ..... B24B 15/00

[52] U.S. Cl. ..... 51/241 A; 51/241 R; 51/241 S; 51/241 B; 51/241 VS; 51/372

[58] Field of Search ..... 51/241 R, 241 S, 241 B, 51/241 VS, 245, 241 A, 372; 269/48.1; 403/44

[56] References Cited

U.S. PATENT DOCUMENTS

| | | | |
|---|---|---|---|
| 819,578 | 5/1966 | McCoy | 51/372 |
| 1,587,053 | 6/1926 | Tornblom . | |
| 1,604,677 | 10/1926 | Brandsitter | 51/372 X |
| 1,748,877 | 2/1930 | Green . | |
| 1,991,834 | 2/1935 | Albertson . | |
| 2,042,782 | 6/1936 | Hall . | |
| 2,278,320 | 3/1942 | Katz | 403/44 |
| 2,298,367 | 10/1942 | Glaude | 51/372 X |
| 2,448,100 | 8/1948 | Kruse . | |
| 2,567,319 | 9/1951 | Christensen . | |
| 2,665,489 | 1/1954 | Cunningham | 403/44 X |
| 2,784,538 | 3/1957 | Clark | 51/245 |
| 2,905,491 | 9/1959 | Olson | 403/44 |
| 3,594,962 | 7/1971 | Christensson . | |
| 3,803,981 | 4/1974 | Allgeyer . | |
| 4,086,732 | 5/1978 | Ramsey | 51/241 S |

*Primary Examiner*—Robert C. Watson
*Assistant Examiner*—Willmon Fridie, Jr.
*Attorney, Agent, or Firm*—Henry Hansen; Robert F. Beers

[57] ABSTRACT

A grinder for preparing circular seats behind elliptical handholes of marine boilers. An air motor, mounted within an expandable housing, drives a grinding wheel against the inside surface of the handhole. The housing is expanded to be secured in the elliptical handhole. The center of the motor orbits on a circle about the center of the housing so that a circular seat is formed about the inside edge of the elliptical handhole.

12 Claims, 4 Drawing Figures

HANDHOLE SEAT RESURFACING TOOL FOR NAVAL PRESSURE FIRED BOILERS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a self contained boiler header seat motor driven grinding tool having an integral adjustable clamping device which allows the tool to be securely mounted within an elliptical oblong handhole above the seat which is being resurfaced. The motor is located eccentrically to the mean centers of the elliptical handhole. This predetermined eccentricity allows the tool to grind a round seating surface behind the elliptical handhole.

Handhole seat and boiler headers are subject to corrosion and steam errosion resulting in leakage when under pressure. Repairing these seats is a slow and costly procedure requiring industrial assistance with a special machine. This repair can be further slowed where access to handhole seats is obstructed by lagging piping and other associated equipment. In some cases, obstructed handhole seats can not be satisfactorily repaired and require welding of the handhole plug into the seat to stop the leak. This welded joint prevents subsequent access to tube ends for cleaning, rolling or plugging, and must eventually be cut out and the seat repaired during a major overhaul. Due to the location and access space available on all marine boilers commercially available tools do not fit into the limited areas and repairs can only be accomplished with major boiler modifications. The commercial tool has a four point leveling plate which must be secured to an adjacent handhole. The operator adjusts this plate to insure a truly square seat within the hole being refinished. Set-up time is considerable and requires locating the leveling plate within an adjacent handhole. The cutting portion of the tool is lead to the defective handhole with an assortment of universal joints. If no adjacent handhole is available a commercially available tool can not be used without the manufacturing of a special jig for fixtures. The results achieved utilizing commercial tools depends highly on the skill of the operator to cut a square seat. With such critical adjustments necessary it is easy to grind a seat inaccurately. Even if the tool is perfectly aligned with this leveling plate there is considerable misalignment within the universal joint causing the seat to be ground incorrectly. Additionally, the commercially available tool traces the handhole itself using the boiler penetration as a guide. This causes a tool to grind an elliptical seating surface behind an elliptical handhole. This is a direct deviation from the boilers design and specifications which show a circular seating surface behind the elliptical handhole.

SUMMARY OF THE INVENTION

Accordingly, a general purpose and object of this invention is to provide an improved handhole seat grinding tool which is self contained within an adjustable integral clamping device which allows the fixture to secure squarely within the handhole which is being resurfaced. Another object is to provide a tool which is compact, self-contained, fits into the space available, and operates within the handhole which it is resurfacing. Still another object is to provide a tool which is self-conntained with an integral clamping device which accurately locates and locks the tool within the handhole it is resurfacing. Yet another object is to provide a tool which does not require auxillary equipment or special jigs and fixtures necessary to support it during its operation. Still another object is to provide a tool which is unique in design which does not rely on the operator to insure a square cutting aptitude. It is a further purpose of the invention to provide a tool to restore seating surfaces of defective handholes to original boiler design specifications such as grinding a circular seat behind an elliptical handhole.

Briefly, these and other objects of the present invention are accomplished by utilizing a handhole seat resurfacing tool comprising an air motor mounted within an expandable housing which drives a grinding wheel against the inside surface of the handhole. The housing is expandable and therefore securable in the elliptical handhole. The center of the motor orbits in a circular path about the center of the housing so that a circular seat is grounded and reformed about the inside edge of the round header below the elliptical handhole.

These and other objects of the present invention can be more readily understood, and the uniqueness of the resurfacing tool and more particularly the handhole seat resurfacing tool for Naval pressure fired boilers as well as its manner of construction and use more readily appreciated from the following detailed description, taken in conjunction with the accompanying drawings forming a part hereof in which:

DESCRIPTION OF THE PREFERRED EMBODIMENT

Figure 1:
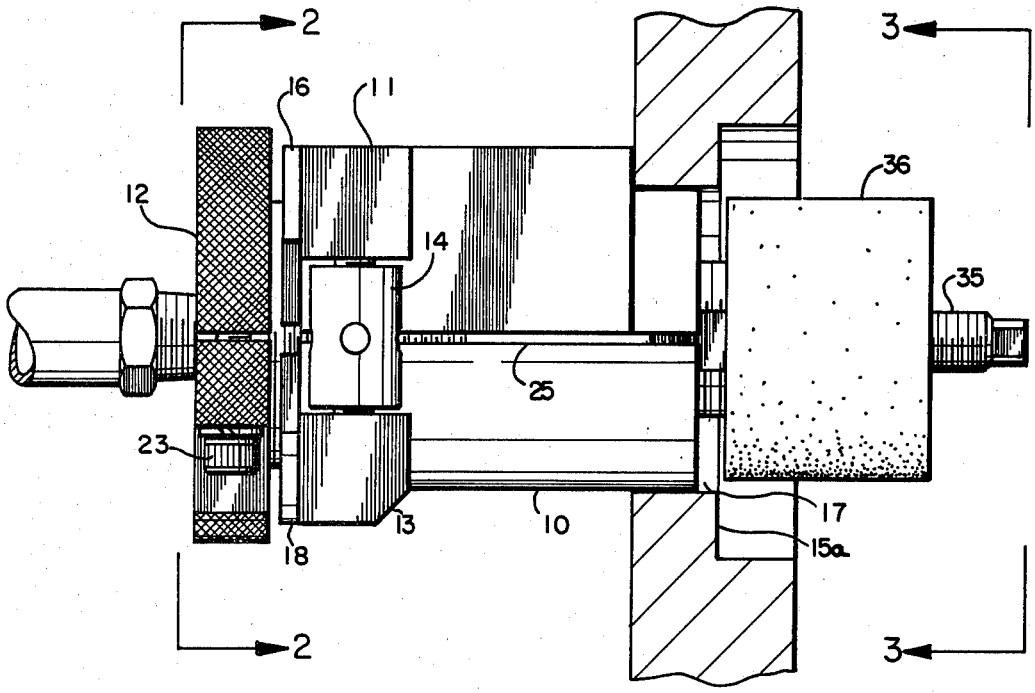
FIG. 1 shows a plane view, of a preferred embodiment of the invention installed in a boiler handhole.
Figure 2:
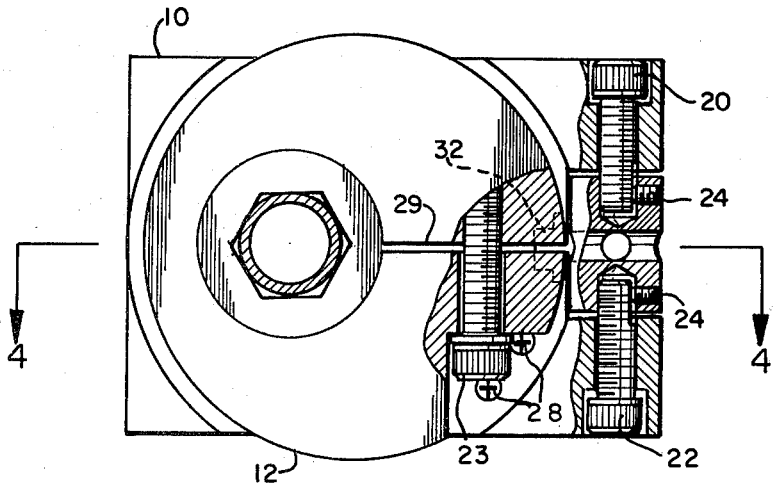
FIG. 2 illustrates a front end view of the invention as seen along the lines 2—2 of FIG. 1.
Figure 3:
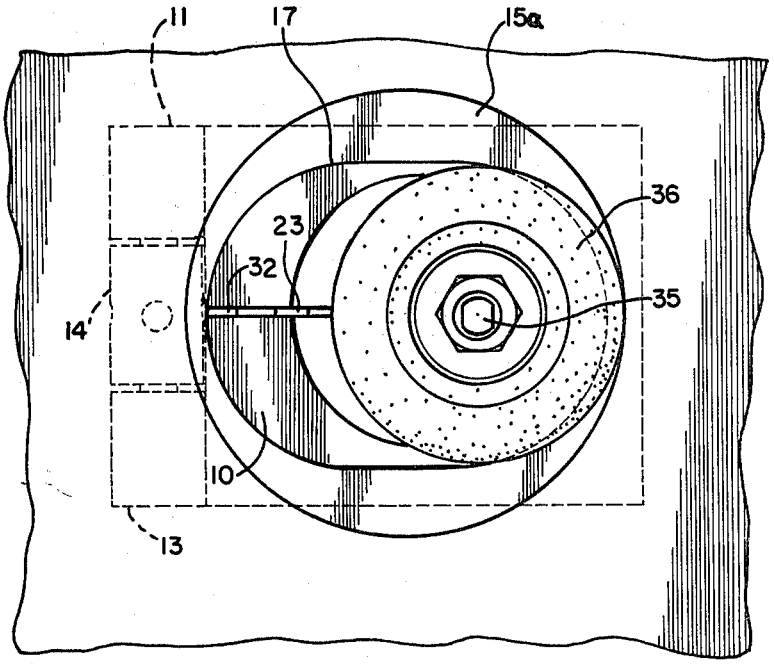
FIG. 3 shows a rear end view of the invention partially in cross section as seen along the line 3—3 of FIG. 1.
Figure 4:
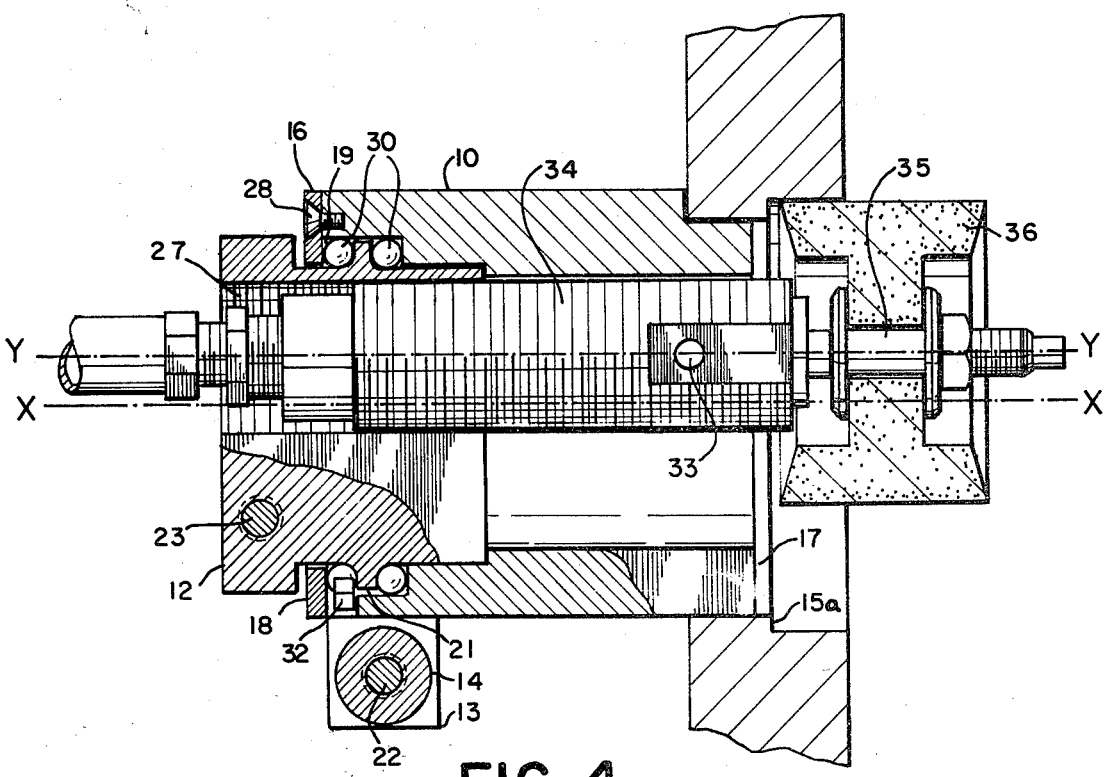
FIG. 4 is a longitudinal cross section taken along the line 4—4 of FIG. 2.

Referring now to the embodiment of FIG. 1 there is shown a clamp housing 10 having an elliptical outer shape at one end for the purpose of fitting into an elliptical handhole 17 and having a first inner diameter at one end and a second inner diameter at the other end of the housing. Housing 10 has a longitudinal split 25 in the wall which allows the shape to be expanded or contracted. The other end of housing 10 is externally rectangularly shaped and has rectangular metal ears 11 and 13 each extending from one corner. Ears 11 and 13 each contain a clearance hole for the socket head of screws 20 and 22 respectively. The bottom of each clearance hole in conjunction with the screw head acts as a fail-safe to prevent the housing from being expanded too far. A threaded clamp spool 14 is disposed between ears 11 and 13. Screws 20 and 22 thread through ears 11 and 13 and then thread into opposite ends of spool 14. Set screws 24 thread into spool 14 make contact with and lock screws 20 and 22 along a flat portion thereof. A raceway 19 is formed in the inside diameter of the other end of housing 10 to provide space for ball bearings 30.

A spindle tensioner 12 having a cylindrical shape has on one end a large knurled diameter portion and on the other end is rotatably disposed in the other end of housing 10. A ridge 21 encircles tensioner 12 and lines up in the center of raceway 19 forming the three sides of containment for the bearings 30.

Left bearing retainer 16 and right bearing retainer 18 are connected to the other end of housing 10 and provide the fourth containment wall for bearings 30. A bearing stop block 32 is connected to housing 10 adjacent to spool 14 and under retainer 18 for the purpose of preventing bearings 30 from falling out of raceway 19 in the event housing 19 is expanded too much. A threaded motor hole 27 is provided through tensioner 12 in which is mounted an air driven motor 34. The center of hole 27 is axis Y—Y and is located eccentrically so that motor 34 orbits the inside diameter of housing 10 when tensioner 12 is rotated. Tensioner 12 has a radial split 29 from its circumference to its center opposite the location of the motor hole 27. A lock motor screw 23 passes through one half of the knurled portion of tensioner 12 on one side of split 29 and then threads into the other side of tensioner 12 on the other side of split 29. Expansion or contraction of hole 27 is effectuated by loosening or tightening lock motor screw 23 and thereby increasing or decreasing the spread of split 29.

Motor 34 is threaded into tensioner 12 which is rotatably disposed in housing 10. Motor 34 is connected to receive air pressure at the tensioner end and to exhaust it from hole 33 automatically cleaning the grinding area. A shaft 35 connects motor 34 to a grinding wheel 36 for resurfacing header 15. Motor 34 is positioned on motor axis Y—Y eccentrically to the mean center axis X—X of the elliptical handhole. This predetermined eccentricity causes grinding wheel 36 to grind a round seating surface 15*a* on header 15 behind the elliptical handhole 17.

Operation of the Handhole Seat Resurfacing Tool for Naval Pressure Fired Boilers is now summarized with reference to FIGS. 1–5. A grinding wheel 36 is connected to an air-driven motor 34 by a shaft 35. The body of motor 34 is inserted into tension spindle 12 until the side of grinding wheel 36 adjacent to the one end of clamp housing 10 is in grinding contact with the seat 15*a* of header 15 when clamp housing 10 is flush with the outside of header 15. The width of clamp housing 10 is reduced to its minimum by turning a clamp spool 14 and is inserted into a defective handhole grinding wheel first, until the one end of clamp housing 10 is flushed with the outside of header 15. Holding the assembly securely in this position, clamp spool 14 is turned to expand the width of clamp housing 10 until it is securely locked in place within the defective handhole. Lock motor screw 23 is tightened so that motor 34 is securely held in hole 27 of spindle 12. Spindle 12 is turned a full 360° to verify no contact between grinding wheel 36 and the side wall of the counter bore inside header 15. Air pressure is now connected to drive motor 34 rotating same so as to resurface the seat of the defective handhole. The thrust of motor 34 developed during grinding is transmitted to housing 10 and not to the header 15 insuring flat and square grinding of seat surfaces behind a defective handhole.

Therefore, some of the many advantages of the present invention should now be apparent. In summary, the use of handhole seat resurfacing tool for naval pressure fire boilers provides an improved handhole seat grinding tool which is self contained within an adjustable integral clamping device that allows the tool to be securely and squarely mounted within a defective handhole which needs resurfacing. Another advantage is that the tool can be accurately located and locked within the same handhole it is resurfacing. Yet another advantage is that it does not require auxilliary equipment for special jigs and fixtures to support it during its operation. Still another advantage is that tool effectiveness does not rely on the operator to insure a square cutting aptitude. With this tool, a circular header seat lying behind an elliptical hand hold may be correctly and cheaply restored.

Obviously, many modifications and variations of the present invention are possible in the light of the above teachings. It is therefore to be understood that, within the scope of the appended claims, the invention may be practiced otherwise than as specifically described.

What is claimed is:

1. An apparatus for grinding a circular sealing surface behind an oblong opening of a boiler wall or the like, the central axes of the opening and the surface being coaxial, comprising:

an expandable housing having a longitudinal split in an outer wall and shaped at one end for contiguous insertion on the central axes normal to the opening;

a tensioner coaxially extending through said housing and rotatable in said housing on the central axis;

a motor longitudinally secured within said tensioner having an output shaft rotatable on an axis displaced from the central axis for extending through the opening when said housing is inserted; and a grinding wheel mounted on said shaft for rotation therewith configured to form the desired sealing surface.

2. An apparatus as recited in claim 1, wherein said expandable housing further comprises:

spreader means operatively connected between opposed surfaces of said longitudinal split for expanding said housing against the inner surface of the opening.

3. Apparatus according to claim 2 wherein said spreader means further comprises:

spool means threadingly connected between said opposed surfaces with oppositely threaded ends.

4. Apparatus according to claim 3 further comprising:

limit means operatively connected between said housing and the ends of said spool means for limiting the expansion of said housing.

5. An apparatus as recited in claim 4, wherein said limit means further comprises:

shoulders extending from each end of said spool means; and seats formed in said housing at said opposed surfaces for engaging said shoulder when said housing is expanded a predetermined amount.

6. Apparatus according to claim 3 wherein said housing further comprises:

a circular race on the inner surface of said housing; and bearings positioned in said race for rotatably supporting said tensioner.

7. Apparatus according to claim 6 further comprising:

block means positioned in said race at said housing split for preventing escape of said bearings when said housing is expanded.

8. Apparatus according to claim 3 wherein said tensioner further comprises:

a flange portion extending from the housing at the end distal from said grinding wheel formed for manual rotation of said tensioner.

9. Apparatus according to claim 8 wherein said tensioner further comprises:

a longitudinal split in the tensioner; and locking means threadingly connected between the opposed surfaces of said split for positively securing said motor in engagement with said tensioner.

10. An apparatus for grinding a circular surface behind an oblong wall opening, the central axes of the opening and the surface being coaxial, comprising:

an expandable housing having a longitudinal split in an outer wall and shaped at one end for contiguous insertion on the central axes normal to the opening;

a tensioner coaxially secured within said housing and rotatable in said housing on the central axis;

a motor longitudinally extending through said tension having an output shaft rotatable on an axis displaced from the central axis for extending through the opening when said housing is inserted; and a grinding wheel mounted on said shaft for rotation therewith configured to form the desired sealing surface.

11. An apparatus as recited in claim 10, wherein said expandable housing further comprises:

spreader means operatively connected between opposed surfaces of said longitudinal split for expanding said housing against the inner surface of the opening.

12. Apparatus according to claim 11 wherein said spreader means further comprises:

spool means threadingly connected between said opposed surfaces with oppositely threaded ends.

* * * * *